US005229349A

United States Patent [19]

Kurisu et al.

[11] Patent Number: 5,229,349

[45] Date of Patent: Jul. 20, 1993

[54] THERMOSENSITIVE RECORDING MATERIAL

[75] Inventors: Norio Kurisu, Susono; Hideo Aihara; Yoshifumi Noge, both of Numazu; Yasuhiko Watanabe, Shizuoka, all of Japan

[73] Assignee: Ricoh Company, Ltd., Tokyo, Japan

[21] Appl. No.: 765,184

[22] Filed: Sep. 25, 1991

[30] Foreign Application Priority Data

Sep. 26, 1990 [JP] Japan ..... 2-256575

[51] Int. Cl.[5] ..... B41M 5/40

[52] U.S. Cl. ..... 503/200; 427/152; 503/207; 503/226

[58] Field of Search ..... 503/200, 207, 226; 427/152

[56] References Cited

FOREIGN PATENT DOCUMENTS 245590 12/1985 Japan ..... 503/207

*Primary Examiner*—Pamela R. Schwartz

*Attorney, Agent, or Firm*—Oblon, Spivak, McClelland, Maier & Neustadt

[57] ABSTRACT

A thermosensitive recording material is composed of a support, a thermosensitive coloring layer capable of inducing color formation upon application of heat thereto, formed on the support, and an overcoat layer formed on the thermosensitive coloring layer, the overcoat layer being essentially composed of a resin component which is crosslinked by a glycidylamine compound serving as a crosslinking agent for the resin component. A coating liquid for the formation of the overcoat layer is essentially composed of the resin component and the glycidylamine compound.

12 Claims, No Drawings

THERMOSENSITIVE RECORDING MATERIAL

BACKGROUND OF THE INVENTION

1. Field of the Invention

This invention relates to a thermosensitive recording material, and more particularly to a thermosensitive recording material comprising a thermosensitive coloring layer formed on a support, and an overcoat layer formed on the thermosensitive coloring layer, which overcoat layer comprises a resin crosslinked by a glycidylamine compound. The overcoat layer can be formed by coating a coating liquid comprising the resin and the glycidyamine compound.

2. Discussion of Background

Conventionally, there is known a thermosensitive recording material, in which a thermosensitive coloring layer comprising as the main component a thermosensitive coloring composition is provided on a support such as a sheet of paper or synthetic paper, or a plastic film. In such a recording material colored images ar obtained by application of heat to the recording material using a thermal head, a thermal pen, laser beam, a stroboscopic lamp, or the like.

This type of thermosensitive recording material has wide-scale utilization, not only as a recording material for copying books and documents, but also as a recording material for use with printers for electronic calculators, facsimile machines, ticket vendors, and label-recorders because of the following advantages over other conventional recording materials:

(1) images can be speedily recorded by using a comparatively simple device without complicated steps such as development and image fixing;

(2) images can be recorded without generating noise and causing environmental pollution; and (3) the manufacturing cost is low.

The thermosensitive coloring composition for use in this type of thermosensitive recording material usually comprises a coloring agent and a color developer capable of inducing color formation in the coloring agent upon application of heat thereto. Conventionally, as such coloring agents, colorless or light-colored leuco dyes having, for example, lactone, lactam, or spiropyran rings, are employed; and as such color developers, organic acids and phenolic materials are employed. The thermosensitive recording material in which the aforementioned leuco dye and color developer are used in combination is widely used, since the color tone of the produced images is clear, the whiteness degree of the background of the thermosensitive recording material is high, and the produced images have excellent weathering resistance.

The above-mentioned thermosensitive recording material, however, has the shortcoming that recorded images become easily discolored or fade away when the recorded images come into contact with oils and plasticizers such as dioctyl adipate and dioctyl phthalate contained in a plastic film, and that the background area is colored. As a solution to the above problems, it has been proposed that a protective layer be provided on the thermosensitive coloring layer. Japanese Laid-Open Patent Application No. 56-146794 discloses a thermosensitive recording material comprising a protective layer which comprises water-soluble resins such as polyvinyl alcohol and starch, crosslinked by crosslinking agents such as glyoxal and epoxy compounds, and auxiliary agents for matching improvement such as a wax and a filler of, for instance, calcium carbonate or silica. Such a thermosensitive recording material can attain a certain degree of oil resistance and plasticizer resistance. However, the problems related to oil resistance and plasticizer resistance of the thermosensitive recording material are in fact not completely solved.

It is also proposed that two protective layers be laminated to improve the oil resistance of the thermosensitive recording material, as disclosed by Japanese Laid-Open Patent Applications No. 59-45191 and No. 59-67081. However, such thermosensitive recording materials have the shortcoming that the color formation sensitivity is poor.

Another problem of the protective layer is water resistance: The protective layer is peeled off the thermosensitive coloring layer when it comes into contact with water. Japanese Laid-Open Patent Application No. 60-192683 discloses that the problem of water resistance can be solved to some extent by containing melamin and an acid catalyst in the protective layer. In this case, however, the thermosensitive recording material has the shortcoming that the pot life of a coating liquid for the protective layer is short.

SUMMARY OF THE INVENTION

Accordingly, an object of the present invention is to provide a thermosensitive recording material which has excellent oil resistance, plasticizer resistance, water resistance, and image formation reliability.

Another object of the present invention is to provide an overcoat layer formation coating liquid with a long pot life by which an overcoat layer for the thermosensitive recording material is formed.

The first object of the present invention can be attained by a thermosensitive recording material comprising: (a) a support, (b) a thermosensitive coloring layer, formed on the support, which induces color formation upon application of heat thereto, and (c) an overcoat layer, formed on the thermosensitive coloring layer, which comprises a resin component crosslinked by a glycidylamine compound.

The second object of the present invention can be attained by a coating liquid comprising a resin component and a glycidylamine compound, to which a filler, a lubricant or a diluent such as water may be added.

DESCRIPTION OF THE PREFERRED EMBODIMENTS

Unlike conventional crosslinking agents such as glyoxal, an epoxy compound, and a melamin resin, glycidylamine compounds not only impart excellent oil resistance and water resistance to an overcoat layer of a thermosensitive recording material, but also impart a long pot life to a coating liquid for the overcoat layer.

As the glycidylamine compounds serving as crosslinking agents for the overcoat layer of the thermosensitive recording material according to the present invention, those having groups represented by the following formula can be employed:

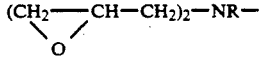

wherein R represents a bivalent hydrocarbon group such as an alkylene group, an arylene group, or an aralkylene group.

Specific examples of the glycidylamine compounds are as follows:

TABLE 1

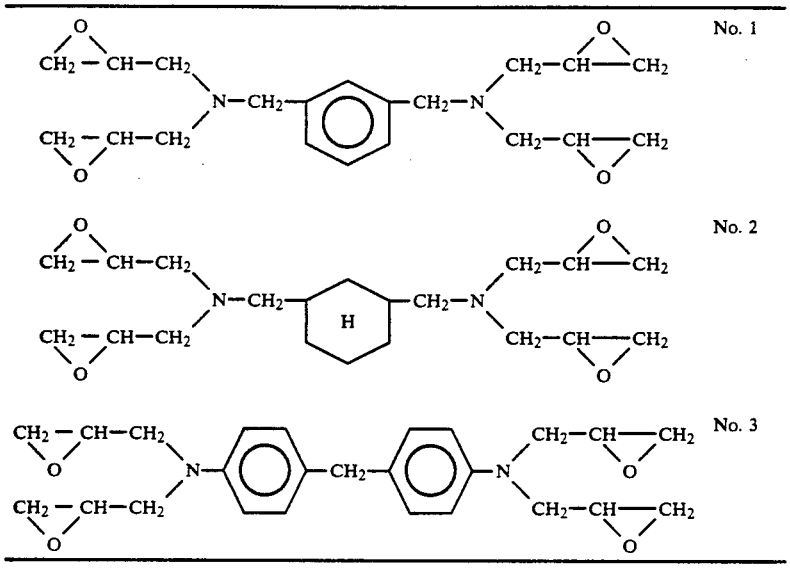

Conventional crosslinking agents such as polyamide-epichlorohydrin can also be employed in combination with the above-mentioned glycidylamine compounds.

Examples of a resin for use in the overcoat layer are as follows: water-soluble resins such as polyvinyl alcohol, cellulose derivatives, starch and starch derivatives, carboxyl-group-modified polyvinyl alcohol, polyacrylic acid and derivatives thereof, styrene-acrylic acid copolymer and derivatives thereof, poly(meth)acrylamide and derivatives thereof, styrene-acrylic acid-acrylamide copolymer, amino-group-modified polyvinyl alcohol, epoxy-modified polyvinyl alcohol, polyethylene-imine, aqueous polyester, aqueous polyurethane, isobutylene-maleic anhydride copolymer and derivatives thereof; polyester; polyurethane; acrylic acid ester (co)polymers; styrene-acryl derivative copolymers; epoxy resin; polyvinyl acetate; polyvinylidene chloride; polyvinyl chloride and derivatives thereof. Among those resins, the water-soluble resins are preferable for use in the overcoat layer in the present invention.

Furthermore in the present invention, when necessary, auxiliary additive components such as a filler, a thermofusible material (or lubricant), a surface active agent, and a pressure-coloring preventing agent, which are used in conventional thermosensitive recording materials, can also be contained in the overcoat layer.

Examples of the filler for use in the present invention include finely-divided particles of inorganic fillers such as calcium carbonate, silica, zinc oxide, titanium oxide, aluminum hydroxide, zinc hydroxide, barium sulfate, clay, talc, surface-treated calcium and surface-treated silica; and finely-divided particles of organic fillers such as urea-formaldehyde resin, styrene-methacrylic acid copolymer and polystyrene resin.

Examples of the thermofusible material are as follows: higher fatty acids and esters, amides, and metal salts thereof; and other thermofusible organic compounds with a melting point ranging from 50° to 200° C., such as various kinds of waxes, condensates of aromatic carboxylic acids and amines, phenyl benzoate, higher straight-chain glycol, dialkyl 3,4-epoxy-hexahydrophthalate, higher ketone, and p-benzyl biphenyl.

For the color formation in the thermosensitive recording material of the present invention with application of heat thereto, methods of utilizing the reaction between a leuco dye and a color developer, that between a diazo compound and a coupling agent, and that between an isocyanate and an amine can be employed. The method of color formation, however, is not specifically restricted to the above three methods. A process of color formation between a leuco dye and a color developer will now be explained as a conventional method of color formation.

In the present invention, as the leuco dyes for use in the thermosensitive coloring layer, which can be used alone or in combination, any conventional leuco dyes for use in conventional thermosensitive materials can be employed. For example, triphenylmethane-type leuco compounds, fluoran-type leuco compounds, phenothiazine-type leuco compounds, auramine-type leuco compounds, spiropyran-type leuco compounds, and indolinophtalide-type leuco compounds are preferably employed. Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-N-methyl-N-isobutyl-6-methyl-7-anilinofluoran,
3-N-ethyl-N-amyl-6-methyl-7-anilinofluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran, 2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-diethylamino-6-methyl-7-(2',4'-dimethylanilino)fluoran,
3-(N,N-diethylamino)-5-methyl-7-(N,N-dibenzylamino)fluoran, benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-[2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide, 3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)-fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)-fluoran,
3-diethylamino-7-piperidinofluoran,
2-chloro-3-(N-methyltoluidino)-7-(p-n-butylanilino)-fluoran,
3-(N-methyl-N-isopropylamino)-6-methyl-7-anilinofluoran,
3-dibutylamino-6-methyl-7-anilinofluoran,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluoran,
3-diethylamino-6-chloro-7-anilinofluoran,
3-N-ethyl-N-(2-ethoxypropyl)amino-6-methyl-7-anilinofluoran,
3-N-ethyl-N-tetrahydrofurfurylamino-6-methyl-7-anilinofluoran, and
3-diethylamino-6-methyl-7-mesidino-4',5'-benzofluoran, As the color developers for use in the thermosensitive coloring layer in the present invention, various electron acceptors which work upon the above-mentioned leuco dyes to induce color formation, such as phenolic compounds, thiophenolic compounds, thiourea derivatives, organic acids and metal salts thereof, are preferably employed.

Specific examples of such color developers are as follows:

4,4'-isopropylidenebisphenol,
4,4'-isopropylidenebis(o-methylphenol),
4,4'-sec-butylidenebisphenol,
4,4'-isopropylidenebis[2-tert-butylphenol),
4,4'-cyclohexylidenediphenol,
4,4'-isopropylidenebis(2-chlorophenol),
2,2'-methylenebis(4-methyl-6-tert-butylphenol),
2,2'-methylenebis(4-ethyl-6-tert-butylphenol),
4,4'-butylidenebis(6-tert-butyl-2-methylphenol),
1,1,3-tris(2-methyl-4-hydroxy-5-tert-butylphenyl)butane,
1,1,3-tris(2-methyl-4-hydroxy-5-cyclohexylphenyl)-butane,
4,4'-thiobis(6-tert-butyl-2-methylphenol),
4,4'-diphenolsulfone,
4,4'-isopropoxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,7-bis[4-hydroxyphenylthio)-3,5-dioxaheptane,
1,5-bis(4-hydroxyphenylthio)-3-oxapentane,
1,3-bis(4-hydroxyphenylthio)-propane,
1,3-bis(4-hydroxyphenylthio)-2-hydroxypropane,
N,N'-diphenylthiourea,
N,N'-di(m-chlorophenyl)thiourea, salicylanilide,
5-chloro-salicylanilide,
2-hydroxy-3-naphthoate,
2-hydroxy-1-naphthoate,
1-hydroxy-2-naphthoate,
metal salts such as zinc, aluminum, calcium of hydroxynaphthoate,
bis-(4-hydroxyphenyl)methyl acetate,
bis-(4-hydroxyphenyl)benzyl acetate,
1,3-bis(4-hydroxycumyl)benzene,
1,4-bis(4-hydroxycumyl)benzene,
2,4'-diphenolsulfone,
3,3'-diallyl-4,4'-diphenolsulfone,
α,α-bis(4-hydroxyphenyl)-α-methyltoluene,
antipyrine complex of zinc thiocyanate,
tetrabromobisphenol A, and
tetrabromobisphenol S.

A variety of conventional binder agents can be employed for binding the leuco dye, the color developer, and the auxiliary additive components to the support of the thermosensitive recording material of the present invention.

Specific examples of the binder agents are as follows: polyvinyl alcohol; starch and starch derivatives; cellulose derivatives such as methoxycellulose, hydroxyethylcellulose, carboxymethylcellulose, methylcellulose, and ethylcellulose; water-soluble polymers such as sodium polyacrylate, polyvinyl pyrrolidone, acrylamide-acrylic acid ester copolymer, acrylamide-acrylic acid ester-methacrylic acid terpolymer, alkali salts of styrene-maleic anhydride copolymer, alkali salts of isobutylene-maleic anhydride copolymer, polyacrylamide, sodium alginate, gelatin, and casein; emulsions such as polyvinyl acetate, polyurethane, polyacrylic acid ester, polymethacrylic acid ester, vinyl chloride-vinyl acetate copolymer, and ethylene-vinyl acetate copolymer; and latexes such as styrene-butadiene copolymer and styrene-butadiene-acrylic acid derivative copolymer.

Moreover, when necessary, the auxiliary additive components which are used in the conventional thermosensitive recording materials, such as a filler and a surface active agent can be employed with the above-mentioned leuco dye and the color developer in the thermosensitive coloring layer. Specific examples of the filler are the same as fillers employed in the overcoat layer.

In the present invention, an undercoat layer comprising a filler and a binder agent can be interposed between the support and the thermosensitive coloring layer. Specific examples of the above filler and the binder agent are the same as those employed in the thermosensitive coloring layer. Furthermore, two overcoat layers can be laminated on the thermosensitive coloring layer or a backcoat layer can be provided on the back side of the support.

The thermosensitive recording material of the present invention can be utilized in a variety of fields especially in high-speed recording as a recording material required to obtain images and the background with improved stability. For example, the thermosensitive recording material of the present invention can be used as a thermosensitive recording type label sheet and thermosensitive recording type magnetic ticket paper.

The thermosensitive recording type label sheet can be obtained by providing the thermosensitive coloring layer comprising the leuco dye and the color developer on a support, forming the previously mentioned overcoat layer on the above thermosensitive coloring layer, and further providing an adhesive layer on the back side of the support with a release backing paper applied to the adhesive layer.

The thermosensitive recording type magnetic ticket paper can be prepared in the same way as the thermosensitive recording type label sheet, except that the release backing paper used for the thermosensitive recording type label sheet is replace by a magnetic recording layer comprising a ferromagnetic substance and a binder as the main components.

Other features of this invention will become apparent in the course of the following description of exemplary embodiments, which are given for illustration of the invention and are not intended to be limiting thereof.

EXAMPLE 1

Preparation of Thermosensitive Coloring Layer

A dispersion A and a dispersion B were separately prepared by pulverizing and grinding the respective mixtures with the following formulations in a sand grinder for 2 to 4 hours:

| | parts by weight |
|---|---|
| [Dispersion A] | |
| 3-(N-methyl-N-cyclohexyl)amino-6-methyl-7-anilinofluoran | 10 |
| 10% aqueous solution of polyvinyl alcohol | 10 |
| Water | 80 |
| [Dispersion B] | |
| 4-hydroxyphenyl-4'-isopropoxyphenylsulfone | 10 |
| Calcium carbonate | 10 |
| 1,1,3-tris(2-methyl-4-hydroxy-5-cyclohexylphenyl)butane | 5 |
| 10% aqueous solution of polyvinyl alcohol | 20 |
| Water | 55 |

One part by weight of dispersion A and 3 parts by weight of dispersion B were mixed and stirred to prepare a coating liquid for a thermosensitive coloring layer. The thus prepared coating liquid for the thermosensitive coloring layer was coated by a labocoating rod on a sheet of commercially available high quality paper in a deposition amount ranging from 5.4 to 5.6 g/m$^2$ on a dry basis, and then dried, so that a thermosensitive coloring layer was formed on the support.

Preparation of Overcoat Layer

One part by weight of polyvinyl alcohol, 0.4 parts by weight of a glycidylamine compound represented by the following Formula No.1 which has been previously given as the glycidylamine compound No.1 in Table 1, 0.5 parts by weight of finely-divided particles of silica serving as a filler, and 0.8 parts by weight of a dispersion of zinc stearate serving as a lubricant were mixed.

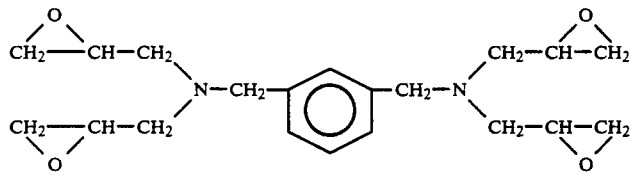

No.1

The above obtained mixture was diluted with water until it had an appropriate viscosity for coating. The thus prepared coating liquid for an overcoat layer was coated on the above-mentioned thermosensitive coloring layer in a deposition amount of 3.5 g/m$^2$ on a dry basis, and then dried, so that the overcoat layer was formed on the thermosensitive coloring layer. Thus a thermosensitive recording material of the present invention was obtained.

EXAMPLES 2 TO 7 AND COMPARATIVE EXAMPLES 1 TO 5

The procedure for preparing the thermosensitive recording material in Example 1 was repeated except that the formulation of a resin component and a crosslinking agent in the coating liquid for the overcoat layer was replaced by the following formulations as shown in Table 2. The mixing ratio of each component is as follows: a resin component : a crosslinking agent : silica : zinc stearate = 1 : 0.4 : 0.5 : 0.8, provided that in Comparative Examples 1 and 2, no crosslinking agent was used.

TABLE 2

| Example No. | Resin Component | Crosslinking Agent |
|---|---|---|
| Example 2 | itaconic-acid-modified polyvinyl alcohol | glycidylamine compound No. 1 in Table 1 |
| Example 3 | aqueous urethane | the same as above |
| Example 4 | acrylic acid - acrylamide copolymer | glycidylamine compound No. 2 in Table 1 |
| Example 5 | styrene - acrylic acid copolymer | the same as above |
| Example 6 | polyvinyl alcohol | JEX-2 (glycidylamine |

TABLE 2-continued

| Example No. | Resin Component | Crosslinking Agent |
|---|---|---|
| | | compound made by Tohto Kasei Co., Ltd.) |
| Example 7 | itaconic-acid-modified polyvinyl alcohol | the same as above |
| Comparative Example 1 | polyvinyl alcohol | — |
| Comparative Example 2 | itaconic-acid-modified polyvinyl alcohol | — |
| Comparative Example 3 | polyvinyl alcohol | glyoxal |
| Comparative Example 4 | the same as above | melamine resin |
| Comparative Example 5 | the same as above | polyamide - epi-chlorohidrin copolymer |

Images were thermally printed on the thus obtained thermosensitive recording materials by a heat gradient tester with a thermal head built in made by Toyo Seiki Seisaku-sho, Ltd. under the following conditions:

| | |
|---|---|
| Temperature | 70 to 150° C. |
| Contact Time | 1 second |
| Applied Pressure | 2 kg/cm$^2$ |

Then each image-bearing sample was subjected to a plasticizer resistance test, an oil resistance test, and a water resistance test to evaluate the preservability of the obtained images and the background. The pot life of each of the coating liquids for the formation of the overcoat layer employed in Examples 1 to 7 and Comparative Examples 1 to 5 was evaluated. the The method of each test is as follows:

(1) Plasticizer Resistance Test

A polyvinyl chloride sheet containing a plasticizer was laminated on an image area printed at 150° C. on each sample, and then a load of 100 g/cm$^2$ was applied thereto. After each sample was allowed to stand at 40° C. for 15 hours in a dry atmosphere, the density of the printed images was measured to evaluate the resistance to the plasticizer.

Oil Resistance Test

A cotton seed oil was coated on the image area printed at 150° C. on each sample. Each sample was allowed to stand at 40° C. for 15 hours in a dry atmosphere. Thereafter, the density of the printed images was measured to evaluate the resistance to the oil.

(3) Water Resistance Test 100 g of water was placed in a 100 cc glass beaker. Each sample with an image area printed at 150° C. was immersed in the water at 20° C. for 15 hours, and the density of the printed images was measured. In addition to the above test, the water resistance of the thermosensitive recording material was evaluated by rubbing each sample taken out from the glass beaker with the finger 10 times, and the peeling of the overcoat layer off the thermosensitive coloring layer was visually inspected.

Pot-life Test

Each coating liquid for the overcoat layer in Examples 1 to 7 and Comparative Examples 1 to 5 was adjusted to have the same concentration and allowed to stand at 30° C. for one day. Thereafter the pot life of each coating liquid was evaluated by visually inspecting the state of each coating liquid.

The results of the above tests are shown in Table 3. The density of the printed images was measured with Macbeth densitometer RD-914 with a filter w-106.

TABLE 3

| Example No. | Image Density before Test | Plasticizer Resistance (Image Density) | Oil Resistance (Image Density) | Water Resistance Image Density | Water Resistance Degree of peeling (*) | Pot Life (**) |
|---|---|---|---|---|---|---|
| Example 1 | 1.39 | 1.30 | 1.42 | 1.20 | 5 | ○ |
| Example 2 | 1.40 | 1.30 | 1.44 | 1.20 | 5 | Δ |
| Example 3 | 1.40 | 1.25 | 1.44 | 1.18 | 5 | ○ |
| Example 4 | 1.40 | 1.32 | 1.46 | 1.26 | 5 | ○ |
| Example 5 | 1.40 | 1.28 | 1.45 | 1.15 | 5 | ○ |
| Example 6 | 1.42 | 1.30 | 1.48 | 1.22 | 5 | ○ |
| Example 7 | 1.40 | 1.30 | 1.46 | 1.24 | 5 | Δ |
| Comparative Example 1 | 1.40 | 1.15 | 1.25 | 0.80 | 1 | ○ |
| Comparative Example 2 | 1.40 | 1.05 | 1.25 | 0.85 | 1 | ○ |
| Comparative Example 3 | 1.39 | 1.10 | 1.20 | 0.90 | 2 | ○ |
| Comparative Example 4 | 1.39 | 1.24 | 1.35 | 1.05 | 2 | x |
| Comparative Example 5 | 1.40 | 1.20 | 1.35 | 1.15 | 3 | x |

(*)
5: No peel off.
4: Slightly peeled off.
3: Fairly peeled off.
2: Considerably peeled off.
1: No overcoat remained.
(**)
○: No change.
Δ: Slight increase in viscosity.
x: Large increase in viscosity.

What is claimed is:

1. A thermosensitive recording material comprising:

a support, a thermosensitive coloring layer capable of inducing color formation upon application of heat thereto, formed on said support, and an overcoat layer formed on said thermosensitive coloring layer, said overcoat layer comprising a resin component which is crosslinked by a glycidylamine compound serving as a crosslinking agent for said resin component.

2. The thermosensitive recording material as claimed in claim 1, wherein said glycidylamine compound includes at least one group represented by formula of:

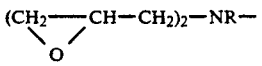

wherein R represents a bivalent hydrocarbon group.

3. The thermosensitive recording material as claimed in claim 2, wherein said bivalent hydrocarbon group represented by R is selected from the group consisting of an alkylene group, an arylene group, and an aralkylene group.

4. The thermosensitive recording material as claimed in claim 1, wherein said glycidylamine compound is selected from the group consisting of the compounds represented by the following formulae:

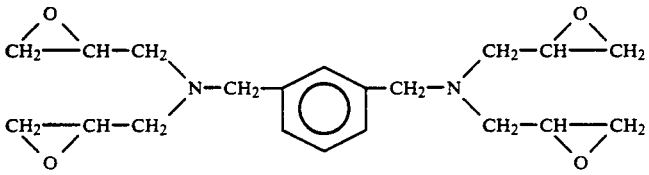

No.1

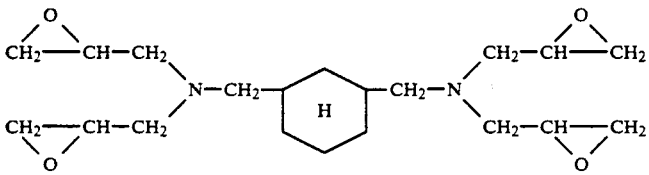

No.2

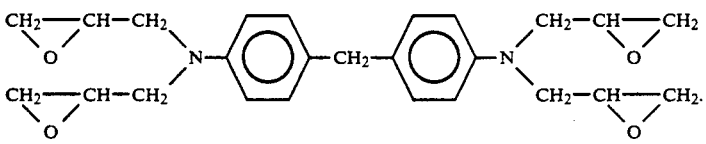

No.3

5. The thermosensitive recording material as claimed in claim 1, wherein said resin component is a water-soluble resin selected from the group consisting of polyvinyl alcohol, cellulose, methoxycellulose, hydroxyethylcellulose, carboxymethylcellulose, methylcellulose, ethylcellulose, starch, carboxyl-group-modified polyvinyl alcohol, polyacrylic acid, sodium polyacrylate, styrene-acrylic acid copolymer, styrene-acrylic acid-acrylamide copolymer, acrylic acid-acrylamide copolymer, amino-group-modified polyvinyl alcohol, epoxy-modified polyvinyl alcohol, polyethylene-imine, polyester, polyurethane, isobutylene-maleic anhydride copolymer and alkali salts of isobutylene-maleic anhydride copolymer.

6. The thermosensitive recording medium as claimed in claim 1, wherein said resin component is selected from the group consisting of epoxy resin, polyvinyl acetate, polyvinylidine chloride, and polyvinyl chloride.

7. The thermosensitive recording material as claimed in claim 1, further comprising an undercoat layer comprising a filler and a binder agent which is interposed between said support and said thermosensitive coloring layer.

8. The thermosensitive recording material as claimed in claim 1, wherein said overcoat layer further comprises a filler.

9. The thermosensitive recording material as claimed in claim 1, wherein said overcoat layer further comprises a thermofusible material.

10. The thermosensitive recording material as claimed in claim 1, wherein said overcoat layer further comprises a lubricant.

11. The thermosensitive recording material as claimed in claim 1, wherein said overcoat layer further comprises a surface active agent.

12. The thermosensitive recording material as claimed in claim 1, wherein said overcoat layer further comprises a pressure-coloring preventing agent.

* * * * *

UNITED STATES PATENT AND TRADEMARK OFFICE

CERTIFICATE OF CORRECTION

PATENT NO. : 5,229,349

DATED : July 20, 1993

INVENTOR(S) : Norio Kurisu, et al

It is certified that error appears in the above-indentified patent and that said Letters Patent is hereby corrected as shown below:

Column 5, Line 19, "3-[2'-hydroxy)" to read --3-(2'-hydroxy--

Column 5, Line 68, "{2-tert-butylphenol)" should read --(2-tert-butylphenol)--

Column 7, Line 42, "is replace by" should read --is replaced by--

Column 9, Line 60, "the The method" should read --The method--

Signed and Sealed this

Sixth Day of December, 1994

*Attest:*

*Attesting Officer*

Bruce Lehman

BRUCE LEHMAN

*Commissioner of Patents and Trademarks*